US007095974B2

(12) United States Patent
Yoshino et al.

(10) Patent No.: US 7,095,974 B2
(45) Date of Patent: Aug. 22, 2006

(54) IMAGE FORMING METHOD USING RECYCLED TONER

(75) Inventors: Susumu Yoshino, Minamiashigara (JP); Motoko Sakai, Minamiashigara (JP); Yoshifumi Iida, Minamiashigara (JP); Sueko Sakai, Minamiashigara (JP); Seki Yamaguchi, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 102 days.

(21) Appl. No.: 10/733,266

(22) Filed: Dec. 12, 2003

(65) Prior Publication Data

US 2004/0234310 A1 Nov. 25, 2004

(30) Foreign Application Priority Data

May 19, 2003 (JP) ..... 2003-140669

(51) Int. Cl.
*G03G 21/00* (2006.01)

(52) U.S. Cl. ..... 399/359

(58) Field of Classification Search ..... 399/120, 399/358–360

See application file for complete search history.

(56) References Cited

U.S. PATENT DOCUMENTS

| | | | | |
|---|---|---|---|---|
| 5,906,906 | A * | 5/1999 | Inoue et al. | 399/359 |
| 2002/0076635 | A1 * | 6/2002 | Yoshino et al. | 430/106.2 |

FOREIGN PATENT DOCUMENTS

| | | | |
|---|---|---|---|
| JP | A 2-89064 | | 3/1990 |
| JP | A 4-452 | | 1/1992 |
| JP | A 5-66607 | | 3/1993 |
| JP | A 5-165250 | | 7/1993 |
| JP | A 7-209902 | | 8/1995 |
| JP | 10073996 | A * | 3/1998 |
| JP | A 10-161342 | | 6/1998 |
| JP | A 11-95553 | | 4/1999 |
| JP | A 11-153881 | | 6/1999 |
| JP | 2001042556 | A * | 2/2001 |
| JP | 2002311775 | A * | 10/2002 |

* cited by examiner

*Primary Examiner*—Arthur T. Grimley
*Assistant Examiner*—Ryan Gleitz
(74) *Attorney, Agent, or Firm*—Oliff & Berridge, PLC

(57) ABSTRACT

An image forming method including a charging step, a latent image forming step, a developing step, a transfer step, and a cleaning step, wherein remaining toner recovered in the cleaning step is used as recycled toner, and a ratio of the recycled toner to a total amount of supply toner supplied to a developer is 15% by weight or greater.

19 Claims, 3 Drawing Sheets

IMAGE FORMING METHOD USING RECYCLED TONER

CROSS-REFERENCE TO RELATED APPLICATION

This application claims priority under 35USC 119 from Japanese Patent Application No. 2003-140669, the disclosure of which is incorporated by reference herein.

BACKGROUND OF THE INVENTION

1. Field of the Invention

The present invention relates to an image forming method used to develop an electrostatic latent image in an electrophotographic method and electrostatic recording method.

2. Description of the Related Art

In an electrophotographic method, an electrostatic latent image formed on the surface of a photoreceptor (latent image holding member) is developed as a toner image by using a toner containing a colorant, the resulting toner image is transferred to the surface of an image recording member directly or through an intermediate transfer member and the transferred toner image is fixed using a heat roll or the like to obtain an image. In the meantime, the latent image holding member is usually cleaned to use it again for the formation of an electrostatic latent image. A dry developer to be used in such an electrophotographic method and the like is roughly classified into a one-component developer which singly uses a toner prepared by compounding a colorant and the like in a binder resin and a two-component developer obtained by mixing a carrier in the toner.

In a general electrophotographic device using such an electrophotographic method, the electrostatic latent image of the latent image holding member is developed using a toner, the toner image is transferred to a receiving member such as an intermediate transfer member and then, the toner image finally transferred to an image-receiving member is fixed in a fixing device. In this case, a toner left untransferred on the latent image holding member after toner transfer is collected in a recovery container by cleaning using a cleaning device and then dumped. Therefore, if this remaining toner can be reused as recycled toner, valid utilization of resources can be achieved.

However, it is pointed out that if the remaining toner is used as recycled toner, problems concerning background pollution, scattering of toners and the like are easily caused because a paper powder of transfer paper (image-receiving member) is intermingled in the toner and toners in which external additives are embedded and finally peeled off are intermingled.

There is a method proposed as techniques for effectively utilizing remaining toner as recycled toner in Japanese Patent Application Laid-Open (JP-A) No. 7-209902 wherein each ratio of the amounts of a releasing agent and external additives between recycled toner and initial toner is defined to limit the deterioration of a carrier thereby improving durability. There is also a method proposed in JP-A No. 11-95553 to better the fluidity and charge stability of a developer by such a combination of an initial toner and a refill toner as to keep the condition that the amount of the external additive in the initial toner is less than that in the refill toner. Further, there is a method disclosed in JP-A No. 11-153881 which method can raise transfer efficiency and decrease a waste toner in a toner composition comprising toners to which two types of fine particles different in sphericity and charge are added and a mother toner to which any fine particle is added by using such a combination that the charge of the mother toner falls between the charge quantities of the toners to which two types of fine particles are added.

However, all the above methods are insufficient as measures for obtaining a high quality image stably by using recycled toner.

In the meantime, in order to maintain the characteristics of a photoreceptor as a latent image holding member for a long term, it is required to control the photoreceptor as a system such that the surface of the photoreceptor is worn to some extent. When the wear of the photoreceptor is too small, the surface of the photoreceptor is polluted, and some defects are tend to occur. The defects include a "white spot" phenomenon, in which image density decreases in copies and print images, and an "image running" phenomenon, in which character images are blurred. Moreover, it is necessary to make the wear to occur uniformly over the entire surface of the photoreceptor.

Therefore, in the case of using recycled toner, it is necessary to keep the photoreceptor uniformly worn.

As a cleaning method for removing remaining toners on the surface of a photoreceptor, there are various methods such as methods using a fur brush or magnetic brush and methods using a cleaning blade formed of elastic material. A method in which a cleaning blade formed of elastic material is used to rub the surface of a latent image holding member, thereby scraping a toner off (this method is sometimes referred to as "blade cleaning" hereinafter) is inexpensive and exhibits stable performance and is therefore usually used. However, this blade cleaning may cause various defects such as wear and scratches of the latent image holding member and it is therefore necessary to control the blade cleaning precisely so as to avoid such defects.

In order to control the blade cleaning stably, a method is proposed in which a titanium oxide particle which has been treated with a fatty acid metal salt, a titanium oxide fine particle which has been surface-treated with hydrolyzing a fatty acid compound in an aqueous system, an inorganic compound which has been surface-treated with a fatty acid metal salt, a fine particle titanium oxide which has been made hydrophobic by surface treatment using fatty acid aluminum or the like is added to a toner particle (see, for example, JP-A Nos. 4-452, 5-66607, 5-165250 and 10-161342). In these methods, the aforementioned problem originated from the size of the particle diameter of the fatty acid metal salt itself is avoided to some extent by using the fatty acid metal salt for surface treatment. However, damages to the surface of a photoreceptor is prevented insufficiently though all these methods have a certain effect.

Meanwhile, in, for example, JP-A No. 2-89064, a hydrophobic hard fine powder is externally added to a toner to abrade a photoreceptor by the abrasive effect of the hard fine powder, thereby preventing toner filming. However, though this method is effective to restrict filming, it has the drawback that the surface of a photoreceptor is worn, which significantly shortens the life of the photoreceptor. Also, a cleaning blade is worn by the hard fine powder and the life of a blade is significantly shortened.

SUMMARY OF THE INVENTION

It is an object of the present invention to solve the above-described problems.

Specifically, it is an object of the invention to provide an image forming method of continuously providing a high quality image stably without any image defect wherein remaining toner recovered from the surface of a latent image holding member in a cleaning step after a transfer step is returned to a developing section or a toner supply section through a toner recovery unit and reused as recycled toner.

Another object of the invention is to provide an image forming method which can stabilize the cleaning characteristics in the cleaning step to maintain the characteristics required for the latent image holding member for a long term.

The present inventors have made earnest studies to attain the above object and as a result, found that the above object can be attained by specifying a toner recycle ratio (the ratio of recycled toner to the total supply toner) to complete the invention.

An aspect of the present invention is to provide an image forming method comprising:

a charging step of charging a surface of a latent image holding member;

a latent image forming step of forming an electrostatic latent image on the surface of the latent image holding member;

a developing step of forming a toner image from the electrostatic latent image by using a developer;

a transfer step of transferring the toner image formed on the surface of the latent image holding member to a surface of a receiving member; and a cleaning step of recovering remaining toner on the surface of the latent image holding member as recycled toner, wherein the recycled toner is supplied to the developer as a part of supply toner and the ratio of the recycled toner to the total amount of supply toner supplied to the developer is 15% by weight or greater.

In the invention, the surface layer of the latent image holding member preferably has charge transport ability and contains a crosslinked resin having a siloxane bond and the shape factor SF1 of the toner is preferably in a range of 100 to 140.

In the invention, the method preferably comprises a toner band forming step of forming a toner band, to be supplied to a cleaning part, on the surface of the image support and the ratio of the recycled toner to the total amount of the supply toner is preferably 20% by weight or greater.

In the invention, the developer to be used preferably comprises a carrier and a toner, the carrier being preferably provided with a resin layer in which a conductive material is contained in a dispersed state in a matrix resin on the surface of a core material. Also, the toner preferably contains a releasing agent.

In the invention, when the image forming method comprises a fixing step, the fixing step is preferably a fixing step in which a releasing liquid is not substantially supplied to the surface of a fixing member.

DETAILED DESCRIPTION OF THE INVENTION

Figure 2:
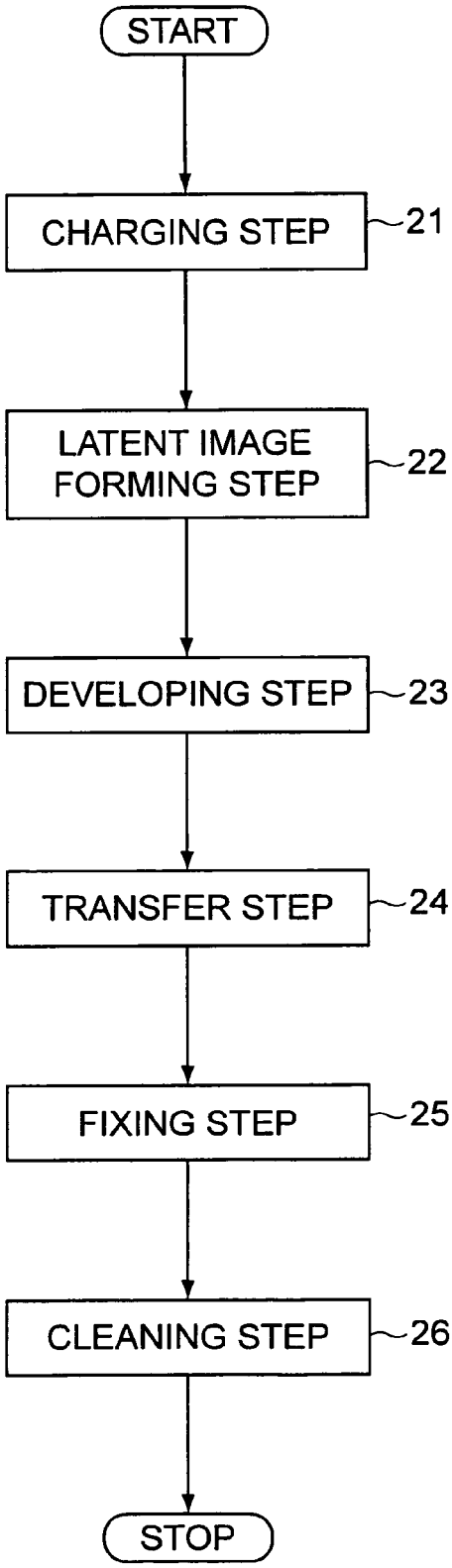
FIG. 2 is a flow diagram showing an exemplary image forming method.
Figure 3:
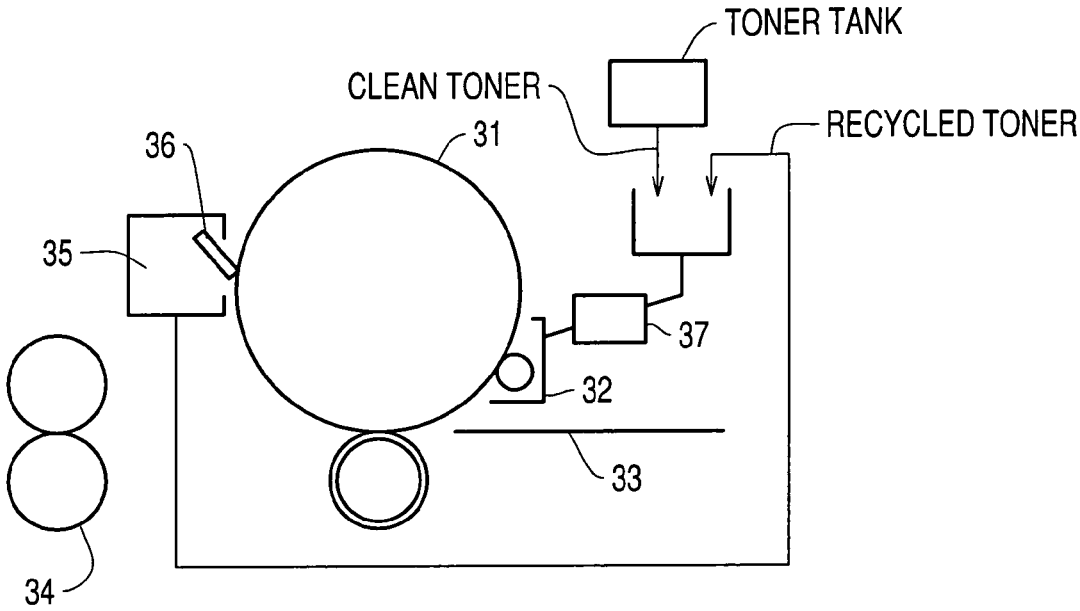
FIG. 3 is an apparatus that can perform the exemplary image method of FIG. 2.

The invention resides in an image forming method as shown in FIG. 2 comprising a charging step 21 of charging the surface of a latent image holding member 31, a latent image forming step 22 of forming an electrostatic latent image on the surface of the latent image holding member, a developing step 23 of forming a toner image from the electrostatic latent image by using a developer 32, a transfer step 24 of transferring the toner image formed on the surface of the latent image holding member to the surface of a receiving member 33, a fixing step 25 of heat fixing the toner image transferred to the receiving member using a fixer 34, and a cleaning step 26 of removing remaining toner on the surface of the latent image holding member using a cleaning device 35, wherein the remaining toner recovered in the cleaning step is reused as recycled toner and the ratio of the recycled toner to the total amount of supply toner supplied to the developer is 15% by weight or greater.

In an image forming method using recycled toner as described above, the recycled toner is less free from the occurrence of embedding and peeling of external additives as compared with an unused toner and therefore causes problems such as a deterioration in image quality and scattering of a toner when it is mixed in a developer. The reason of these problems is that the external additives added to the toner mother particle are separated from or embedded in the toner mother particle by a stress of cleaning and the like, which makes the charge of a toner unstable. In order to improve recycled toner in various characteristics, it is important that there is no or small change in structure between an unused toner and the recycled toner.

Meanwhile, the viewpoint of the related art in improving the above-described problem is to provide a toner itself with a structure which is scarcely changed or to prevent a change in charging characteristics or the like even if the structure of the toner is changed.

The present inventors, as a result of earnest studies, have found that in the case where a large amount of toner is recovered from a cleaning part (a rubbing part between a photoreceptor and a cleaning member) in a cleaning step, the recovered toner can be used as good recycled toner. The reason for this is considered to be that the stress applied to the toner at the cleaning part is distributed because the toner is present there in a large amount so that a stress applied per toner particle becomes small whereby a change in toner structure is limited to a small level.

Also, the presence of abundant toner at the cleaning part stabilizes cleaning characteristics. Since the latent image holding member 31 is rubbed by the cleaning blade 36 to scrape off the remaining toner in the blade cleaning as described above, the edge of the cleaning blade is deformed by the frictional resistance between the latent image holding member and the cleaning blade to form a small wedge-like space (micro tuck-under part). A toner particle penetrating into the micro tuck-under part tends not to be replaced by another and forms a non-flowing region. In fact, the presence of the non-flowing region is important for the blade cleaning and the non-flowing region actually functions so as to scrape off toner.

As a consequence, the presence of abundant toner at the cleaning part ensures that the aforementioned non-flowing region is formed uniformly at the whole micro tuck-under part. This stabilizes cleaning characteristics and can prevent image defects such as a "white spot" phenomenon in which image density decreases and an "image running" phenomenon in which character images are blurred.

As described above, the abundant toner is supplied to the cleaning part in the invention to thereby decrease the stress applied to toner during cleaning and to realize the stabilization of cleaning characteristics at the same time. The amount of toner to be supplied to the cleaning part is indicated by the ratio of the recycled toner to the total amount of toner to be supplied because the recycled toner is stored in a developing unit together with the toner to be supplied when an image forming device is used.

In the invention, the ratio of the recycled toner to the total amount of the aforementioned supply toner should be 15% by weight or greater. When the ratio of the recycled toner is less than 15% by weight, the amount of the toner to be supplied to the cleaning part is insufficient, a change in the structure of the toner cannot be made small and the non-flowing region in the micro tuck-under part cannot be formed uniformly.

The ratio of the recycled toner to the total amount of the supply toner is preferably 20% by weight or greater and more preferably 30% by weight or greater. However, if the ratio of the recycled toner to the supply toner is excessively high, the toner density in a developer after the supply toner is supplied becomes too high to accomplish efficient triboelectric charge with a carrier. Therefore, the upper limit of the ratio is about 50% by weight.

In an image formation device provided with a toner recycle mechanism, recycled toner is not present or is present in a very small amount when an image starts to be formed in an initial stage. Therefore, the term "the ratio of the recycled toner to the total amount of the supply toner should be 15% by weight or greater" is defined in the invention as a requirement which should be satisfied when 5000 sheets of A4 size recording paper (image receiving member) are printed by a new image formation device that has not been subjected to image formation.

The invention will be explained in more detail herein below.

In order to make the ratio of the recycled toner 15% by weight or greater to the total amount of the supply toner, the recycled toner should be supplied abundantly to the cleaning part. However, in the case of forming an image at usual transfer efficiency and recycling toner, the ratio of the recycled toner is in a range of about 5 to 12% by weight, which is out of the target ratio of the recycled toner.

A method used to achieve this target is not particularly limited. One of the methods would be, for example, a method of decreasing the transfer efficiency of toner to increase remaining toner on the surface of a photoreceptor to thereby supply toner abundantly to the cleaning part. Another method would be a method of disposing a so-called toner band in the system to thereby supply toner abundantly to the cleaning part.

A method of forming a toner band which is preferably used in the invention to attain the necessary recycled toner ratio will be explained.

Generally, in the formation of an image in an electrophotographic system, the amount of toner to be supplied to a cleaning part is remarkably decreased at a part that has less images such as a non-image part. The shortage of toner at the cleaning part can be supplemented by supplying toner at the part where the amount of the toner to be supplied is running short when no image is formed (a toner band forming step).

Namely, a toner band with a prescribed capacity is formed not to supply toner excessively to a cleaning part corresponding to a part containing many images on the surface of a photoreceptor and to supply toner in a required amount to a cleaning part corresponding to a part having no or few images. The aforementioned term "when no image is formed" means the time during which a usual image formation cycle is suspended. Examples of such a time include the time during which no recording paper is supplied between an image formation cycle and the next image formation cycle.

As a toner image formed as the above toner band, any pattern may be used as far as toner is supplied to the whole longitudinal direction of a cleaning blade and any of a solid image, halftone image, line image and the like may be used. A toner image formed as a toner band preferably has a length in the rotation (movement) direction of the photoreceptor in a range of 0.5 mm to 20 mm. A toner image preferably has a length in a direction perpendicular to the rotation (movement) direction of the photoreceptor the same as the longitudinal length of the cleaning blade. The preferable image density is in a range of 30 to 100%.

If the length in the direction of the rotation is less than 0.5 mm, toner may not be supplied stably to the cleaning blade irrespective of image density and the surface of the photoreceptor may not be evenly abraded. On the other hand, if the length in the direction of the rotation exceeds 20 mm, toner may be excessively supplied to the elastic cleaning blade.

On the other hand, if the image density is less than 30%, toner may not be supplied stably to the elastic cleaning blade irrespective of image density and the surface of the photoreceptor may not be evenly abraded.

As to timing for forming the toner band, the toner band may be formed every specified number of sheets, specified number of cycles or specified time and also in optional timing. However, the toner band is preferably formed at the interval taken once per from 10 to 200 printed sheets of an A4 size image. If the interval is longer than the above defined interval taken once per 200 printed sheets of an A4 size image, the ratio of the recycled toner to the supply toner may not be stably 15% by weight or greater.

The formation of the toner band when an image is not formed as described above makes it possible to supply toner abundantly in a more stable manner to the sliding and rubbing part between the cleaning blade and the photoreceptor on the whole area where the cleaning blade is in contact with the photoreceptor regardless of the density of an image to be produced and of the variation of time frequency of the image density.

The supply of the toner band can be attained in the following manner. Specifically, integrating image reading information of a CCD sensor or the like in the case of a copying machine or integrating pixel information of output image information at positions in the direction of the axis of the photoreceptor in the case of a printer (the both are collectively referred to simply as "integrating image information") is stored at the optional number of photoreceptors. Based on this information, a toner image corresponding to the integrating image information at each position in the axial direction is produced in a non-image formation cycle to be supplied to the cleaning blade.

In the invention, the timing of formation of the toner band on the surface of the photoreceptor is controlled by a controller 37 in the above manner and the formed toner band is removed by an elastic cleaning blade formed of elastic material, whereby the ratio of the recycled toner to the supply toner can be kept at the specified level as described above. Along with this, a stress applied to toner can be decreased and a change in toner structure can be decreased.

Also, defects caused by the pollution of a photoreceptor such as a "white spot" phenomenon in which image density decreases and an "image running" phenomenon in which character images are blurred, and further, wear and damages can be suppressed, and good cleaning ability can be ensured.

The toner is preferably non-magnetic from the viewpoint of forming a full-color image. Although the developer used in the invention may be either a one-component developer or a two-component developer, it is desirable to use a two-component developer comprising a toner and a carrier from the viewpoint of easiness in controlling the amount of toner charge.

As the toner used for the developer in the invention, toner comprising a binder resin, a colorant and a releasing agent and having a volume average particle diameter range from 2 to 8 μm is preferably used. Toner having a shape factor SF1 ranging preferably from 100 to 140 and more preferably from 110 to 135 is used. This is not only from the viewpoint of obtaining an image having high developing ability, transfer ability and high quality but also from the viewpoint of improving toner fluidity and making it easy to carry the recovered toner (recycled toner) to the developing unit, toner supply section and the like after it is recovered at the cleaning part.

The shape factor SF1 means an average of the values of individual toner particles which values are calculated from the following equation. In the case of a true sphere, SF1 is 100.

$$SF1=(ML^2/A)\times(\pi/4)\times 100$$

In the above equation, ML represents the maximum length of a toner particle and A represents the projected area of a toner particle.

As regards a method of producing the toner used in the invention, the toner is not particularly limited by a production method as far as it satisfies the aforementioned requirements as to the ranges of the shape factor and particle diameter and a known method may be used.

Examples of a method which may be used in the production of the toner include a kneading-milling method in which a binder resin, a colorant, a releasing agent and, as required, a charge control agent and the like are kneaded, milled and classified, a method in which the particle obtained by a kneading-milling method is changed in shape by mechanical impact or thermal energy, an emulsion polymerization coagulating method in which a polymerizable monomer used to obtain a binder resin is emulsion-polymerized, the prepared resin dispersion solution is mixed with a dispersion solution containing a colorant, a releasing agent and as required, a charge control agent and the mixture is coagulated and fused under heating to obtain a toner particle, a suspension polymerization method in which a polymerizable monomer used to obtain a binder resin and a solution containing a colorant, a releasing agent and as required, a charge control agent are suspended to polymerize and a dissolution suspension method in which a solution containing a binder resin, a colorant, a releasing agent and as required, a charge control agent are suspended in an aqueous solvent to granule. Also, a production method in which the toner particle obtained in each of the above methods is used as a core, and a fine particle is stuck to the core and fused under heating to make toner have a core-shell structure may be carried out.

In the case of adding the above internal additives in the inside of a toner particle by, for example, a kneading-milling method when producing the toner used in the invention, the addition is carried out by kneading treatment. The kneading at this time may be carried out using various heat kneaders. As these heat kneaders, a three-roll mill type, single-shaft screw type, two-shaft screw type and Banbury mixer type are known.

As described above, the method of producing the toner used in the invention is optional. However, in, for example, the aforementioned kneading-milling method, a milling method such as an impact plate type or jet type is selected to control the aforementioned shape factor in the production process. Types such as an impact plate type in which toner is collided with some subject are called a surface milling type. Examples of the device include a micronizer, Ulmax and Jet-o-mizer. Also, types in which toners are collided among them are called a volume milling type. Examples of the device include a KTM (krypton) and turbo mill.

Moreover, as a volume/surface milling type having the characteristics of the both which type is structured by providing the above volume milling type with an impact plate, there is an I-type jet-mill and the like. Generally, in the case of a volume milling type, a milled product tends to be amorphous, whereas in the case of a surface milling type, a milled product tends to have a round shape. A change of shape depends on the number of times of classification, a round shape tends to appear by many times of classification. Further, as the subsequent steps, a Hybridization system (manufactured by Nara Machinery Co., Ltd.), Mechanofusion system (manufactured by Hosokawamicron Corporation), Krypton system (manufactured by Kawasaki Heavy Industries Ltd.) are added, whereby the shape of the toner can be changed and also a method of forming a spherical shape by using hot air may be used.

Examples of the binder resin to be used include homopolymers or copolymers of styrenes such as styrene and chlorostyrene; monoolefins such as ethylene, propylene, butylene and isoprene; vinylesters such as vinyl acetate, vinyl propionate, vinyl benzoate and vinyl butyrate; α-methylene aliphatic monocarboxylates such as methylacrylate, ethylacrylate, butylacrylate, dodecylacrylate, octylacrylate, phenylacrylate, methylmethacrylate, ethylmethacrylate, butylmethacrylate and dodecylmethacrylate; vinyl ethers such as vinyl methyl ether and vinyl butyl ether; and vinyl ketones such as vinyl methyl ketone, vinyl hexyl ketone and vinyl isopropenyl ketone. Particularly typical examples of the binder resin include a polystyrene, styrene/alkylacrylate copolymer, styrene/alkylmethacrylate copolymer, styrene/acrylonitrile copolymer, styrene/butadiene copolymer, styrene/maleic acid anhydride copolymer, polyethylene and polypropylene. Also, a polyester, polyurethane, epoxy resin, silicone resin, polyamide, modified rosin and paraffin wax may be exemplified.

Among the aforementioned binder resins, a styrene/alkylacrylate copolymer or polyester is preferably used from the viewpoint of fixing characteristics.

Typical examples of the colorant for the toner include magnetic powders such as magnetite and ferrite, carbon black, Aniline Blue, Chalcoil Blue, Chrome Yellow, Ultramarine Blue, Du Pont Oil Red, Quinoline Yellow, Methylene Blue Chloride, Phthalocyanine blue, Malachite Green Oxalate, Lamp Black, Rose Bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1 and C.I. Pigment Blue 15:3.

The toner used in the invention preferably contains a releasing agent.

As the releasing agent, conventionally known releasing agents may be used. Typical examples of the releasing agent include a low-molecular polyethylene, low-molecular polypropylene, Fisher-Tropsch wax, montan wax, carnauba wax, rice wax and candelilla wax.

It is preferable to use a low-molecular polyethylene, low-molecular polypropylene, carnauba wax or the like as the releasing agent contained in the toner used in the invention from the viewpoint of preventing the binder resin from being plasticized.

The content of the releasing agent is preferably in a range of 3 to 30 parts by mass based on 100 parts by mass of the binder resin.

In the toner used in the invention, a charge control agent may be added according to the need. As the charge control agent, azo type metal complex compounds, metal complex compounds of salicylic acid or resin type charge control agents containing a polar group may be used. When the toner is produced by a wet type production method, it is preferable to use a material which is sparingly soluble in water with the intention of controlling ionic strength and reducing waste fluid pollution. The toner in the invention may be any of a magnetic toner in which a magnetic material is embraced and a non-magnetic toner containing no magnetic material.

In the toner used in the invention, an inorganic powder and a resin powder may be added to the surface of the toner particle in order to improve the long-term preserving ability, fluidity, developing ability and transfer ability of the toner. Examples of the inorganic powder include carbon black, silica, alumina, titania, zinc oxide, strontium titanate, cerium oxide and calcium carbonate. Examples of the resin powder include spherical particles such as a polystyrene, polymethylmethacrylate (PMMA), nylon, melamine resin, benzoguanamine resin and fluorine type resin and amorphous powders such as a vinylidene chloride resin and fatty acid metal salt.

Among the above inorganic powders and resin powders, silica, titania or the like is preferably used in the method of forming an image according to the invention, in which method the toner is recycled, from the viewpoint of powder fluidity.

When the above inorganic powder and resin powder are added to the surface of the toner, each of these powders is added in an amount ranging preferably from 0.1 to 4% by mass and more preferably from 0.2 to 3% by mass. These powders are mixed using a known mixer such as a V-type blender, Henshel mixer or Redige mixer.

Also, the resulting toner may be passed through a classification process after the external additives are mixed without any problem.

In the meantime, a resin coated carrier provided with a resin layer on the surface of a core material is preferably used. It is preferable that a conductive material be dispersed and contained in the resin layer. The reason for this is as follows. When using a spherical toner, packing characteristics are inevitably raised at a carriage limiting part in a developing unit and along with this, strong force is applied not only to the surface of the toner but also to the carrier. For this, if the conductive material is dispersed and contained in the resin layer of the carrier, the volume resistivity is not largely changed and as a result, a high quality image can be maintained for a long period of time even if the resin layer is peeled off.

Examples of a matrix resin used in the resin layer include, though not limited to, a polyethylene, polypropylene, polystyrene, polyacrylonitrile, polyvinyl acetate, polyvinyl alcohol, polyvinylbutyral, polyvinyl chloride, polyvinylcarbazole, polyvinyl ether, polyvinyl ketone, vinyl chloride/vinyl acetate copolymer, styrene/acrylic acid copolymer, straight silicone resin containing an organosiloxane bond or its modified product, fluoro resin, polyester, polyurethane, polycarbonate, phenol resin, amino resin, melamine resin, benzoguanamine resin, urea resin, amide resin and epoxy resin.

Examples of the conductive material include, though not limited to, metals such as gold, silver, copper, titanium oxide, zinc oxide, barium sulfate, aluminum borate, potassium titanate, tin oxide and carbon black.

The content of the conductive material is preferably in a range of 1 to 50 parts by mass and more preferably in a range of 3 to 20 parts by mass based on 100 parts by mass of the coating resin.

Examples of the core material of the carrier include magnetic metals such as iron, nickel and cobalt, magnetic oxides such as ferrite and magnetite and glass beads. It is preferable to use a magnetic brush method and the core material is preferably a magnetic material to control volume resistivity.

The volume average particle diameter of the core material is generally in a range of 10 to 500 μm and preferably in a range of 30 to 100 μm.

Examples of a method of forming the resin layer on the surface of the core material include a dipping method in which the core material is dipped in a coating layer forming solution containing a matrix resin, a solvent and as required, a conductive material, a spray method in which a coating resin layer forming solution is sprayed on the surface of the core material of the carrier, a fluidized bed method in which a coating resin layer forming solution is sprayed in the state that the core material of the carrier is fluidized by fluidizing air and a kneader-coater method in which the core material of the carrier is mixed with a coating layer forming solution in a kneader-coater, followed by removing a solvent.

As the solvent used in the coating resin layer forming solution, any solvent may be used without any particular limitation as far as it dissolves the aforementioned each resin and, for example, aromatic hydrocarbons such as toluene or xylene, ketones such as acetone or methyl ethyl ketone or ethers such as tetrahydrofuran or dioxane may be used.

Also, the average thickness of the resin layer is usually in a range of from 0.1 to 10 μm. In the invention, the average thickness is preferably in a range of from 0.5 to 3 μm to develop the volume resistivity of the carrier stably with time in the invention.

The volume resistivity of the carrier produced in the above manner is preferably in a range of $10^6$ to $10^{14}\Omega\cdot$cm at a potential range from $10^3$ to $10^4$ V/cm which correspond to the upper and lower limits of the usual developing contrast potential to attain a high quality image. When the volume resistivity of the carrier is less than $10^6\Omega\cdot$cm, reproducibility of fine lines is impaired and toner fogging on the background part is easily caused by the injection of a charge. On the other hand, when the volume resistivity of the carrier exceeds $10^{14}\Omega\cdot$cm, reproducibility of a black solid and halftone is impaired. Also, the amount of carriers transferred to the photoreceptor is increased so greatly that the photoreceptor is easily damaged.

Next, the photoreceptor (latent image holding member) used in the invention will be explained.

The photoreceptor used in the invention has at least the ability to form an electrostatic latent image. Although the photoreceptor may be a monolayer type electrophotographic photoreceptor obtained by forming a vapor deposition layer of a charge generating material and the like on the surface of a conductive support, a functional separation type laminate electrophotographic photoreceptor obtained by forming a charge generating layer, a charge transport layer and the like on the surface of a conductive support may be preferably used. Moreover, a photoreceptor which has the same structure as the above photoreceptor except that the surface layer thereof has a charge transport ability and a crosslinked resin having a siloxane bond is more preferable because it is resistant to wear so that a long life can be attained.

In this case, there are the case where a surface protective layer is the surface layer, the case where the charge transport layer or the charge generating layer is the surface layer and the case where the monolayer type light-sensitive layer is the surface layer.

The crosslinked resin having charge transport ability and a siloxane bond is particularly preferable from the viewpoint of transparency, resistance to dielectric breakdown and photo-stability.

The crosslinked resin having a siloxane bond is a resin obtained by crosslinking siloxane, dimethylsiloxane, methylphenyysiloxane and other necessary components three-dimensionally. In the invention, a crosslinked resin containing a compound including an organic group F derived from a photo-functional compound, a flexible organic sub-unit D and a substituted silicon group A having a hydrolyzable group, and having a siloxane bond is preferable because this resin has superior wear resistance and charge transport ability in addition to the aforementioned characteristics.

The aforementioned A is represented by $—Si(R_1)_{(3-a)}Q_a$, wherein $R_1$ represents hydrogen, an alkyl group or a substituted or unsubstituted aryl group, Q represents a hydrolyzable group and a denotes an integer from 1 to 3.

The organic group F derived from a photo-functional compound is preferably a group having hole transport ability or a group having electron transport ability. Particularly specific examples of the group having electron transport ability include organic groups derived from a quinone type compound, fluorenone type compound, xanthone type compound, benzophenone type compound, cyanovinyl type compound or ethylene type compound. Specific examples of the group having hole transport ability include structures having photo-carrier transfer characteristics such as a triarylamine type compound, benzidine type compound, arylalkane type compound, aryl substituted ethylene type compound, stilbene type compound, anthracene type compound, hydrazone type compound, quinone type compound, fluorenone compound, xanthone type compound, benzophenone type compound, cyanovinyl type compound and ethylene type compound.

The substituted silicon group A having a hydrolyzable group represents a substituted silicon group having a hydrolyzable group represented by $—Si(R_1)_{(3-a)}Q_a$. This substituted silicon group serves to initiate a crosslinking reaction among Si groups, thereby forming a three-dimensional Si—O—Si bond, that is, an inorganic glassy network. The flexible organic sub-unit D serves to bind F imparting photoelectric characteristics with a three-dimensional inorganic glassy network by a direct bond. This sub-unit also serves to impart a moderate flexibility to an inorganic glassy network which is hard but fragile on the contrary, thereby improving the strength required for a layer. Specifically, as the substituted silicon group, divalent hydrocarbon groups represented by $—C_nH_{2n}—$, $—C_nH_{(2n-2)}—$ or $—C_nH_{(2n-4)}$ in the case where n is an integer from 1 to 15, —COO—, —S—, —O—, $—CH_2—C_6H_4—$, —N═CH—, $—(C_6H_4)—(C_6H_4)—$, combinations of these groups and groups obtained by introducing a substituent into these groups are used.

Among the compounds containing the above F, D and A, compounds in which F is represented by the following formula (II) exhibit particularly excellent hole transport ability and mechanical characteristics. $Ar_1$ to $Ar_4$ in the formula (II) represent a substituted or unsubstituted aryl group. Specifically, those given by the following structure group 1 are preferable.

Formula (II)

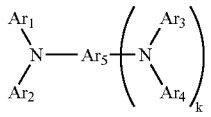

In the formula (II), $Ar_1$ to $Ar_4$ represent a substituted or unsubstituted aryl group, $Ar_5$ represents a substituted or unsubstituted aryl group or arylene group, provided that one to four groups among $Ar_1$ to $Ar_5$ have a connector which can be combined with a connecting group represented by -D-A in the compounds containing F, D and A and k denotes 0 or 1.

Structure group 1

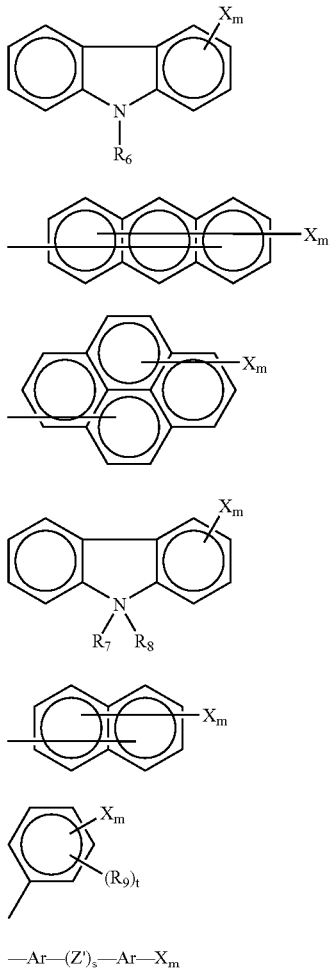

$—Ar—(Z')_s—Ar—X_m$

In the above formula, Ar is preferably one given as the following structure group 2.

Structure group 2

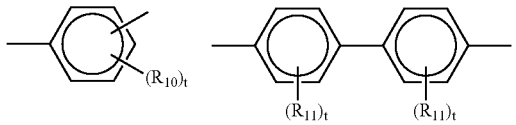

Also, the above Z' is preferably one given as the following structure group 3.

Structure 3

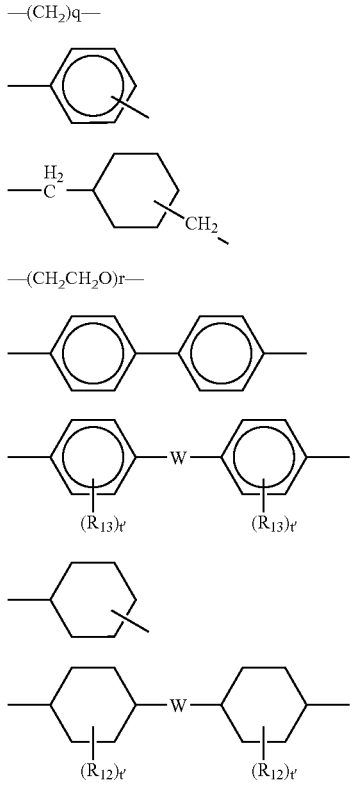

Here, $R_6$ represents hydrogen, an alkyl group having 1 to 4 carbon atoms, a phenyl group substituted with an alkyl group having 1 to 4 carbon atoms or an alkoxy group having 1 to 4 carbon atoms, an unsubstituted phenyl group or an aralkyl group having 7 to 10 carbon atoms. $R_7$ to $R_{13}$ each independently represent hydrogen, an alkyl group having 1 to 4 carbon atoms, an alkoxy group having 1 to 4 carbon atoms, a phenyl group substituted with an alkoxy group having 1 to 4 carbon atoms, an unsubstituted phenyl group, an aralkyl group having 7 to 10 carbon atoms or a halogen, m and s each independently denote 0 or 1, q and r each independently denote an integer from 1 to 10 and t and t' each independently denote an integer from 1 to 3. Here, X is the same as the aforementioned -D-A.

The aforementioned W is preferably one given as the following structure group 4.

Structure group 4

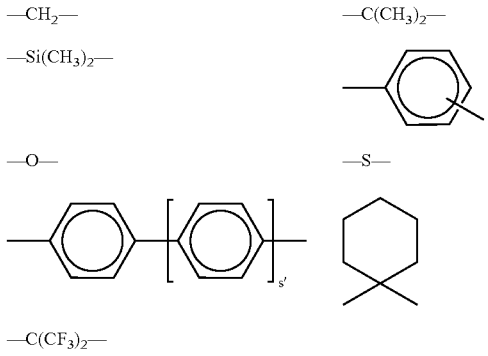

Here, s' represents an integer from 0 to 3.

Specific examples of the structure of $Ar_5$ in the formula (II) include the structures represented by the above $Ar_1$ to $Ar_4$ wherein m=1 when k=0 and the structures represented by the above $Ar_1$ to $Ar_4$ wherein m=0 when k=1.

The photo-functional organic silicon compounds containing F, D and A may be used either singly or in combinations of two or more.

When forming the surface layer, at least one type among compounds having a group which can be bound with the compound containing F, D and A is preferably added for the purpose of improving the mechanical strength of the cured layer.

The group which can be bound with the compound containing F, D and A means a group which can be bound with a silanol group generated when hydrolyzing the compound containing F, D and A and specifically means a group represented by $—Si(R_1)_{(3-a)}Q_a$, an epoxy group, an isocyanate group, a carboxyl group, a hydroxy group or halogen. Compounds having a hydrolyzable group represented by $—Si(R_1)_{(3-a)}Q_a$, an epoxy group or an isocyanate group among these groups are preferable because these compounds have higher mechanical strength.

As the compound having a group which can be bound with the compound containing F, D and A, those having two or more of these groups in each molecule are desirable because they provide a cured layer with a three-dimensional crosslinking structure and impart high mechanical strength to the layer. Examples of the most preferable compounds among these compounds include compounds represented by the formula (III).

$$B\text{-}[A']_n \qquad \text{Formula (III)}$$

In the formula (III), A' represents a substituted silicon group having a hydrolyzable group represented by $—Si(R_1)_{(3-a)}Q_a$, B is constituted of at least one group selected from a hydrocarbon group having n valences which hydrocarbon group may be branched, a phenyl group having n valences, —NH— and —O—Si— or a combination of these groups, a denotes an integer from 1 to 3 and n denotes an integer of 2 or more.

The compounds represented by the formula (III) are compounds having two or more substituted silicon groups A' having a hydrolyzable group represented by $—Si(R_1)_{(3-a)}Q_a$. The Si group part contained in A' reacts with the compound containing F, D and A or with the compound (III) itself to form a Si—O—Si bond, thereby forming a three-dimensional crosslinking cured layer. Since the compound containing D, D and A also has the same Si group, it can form a cured layer by itself alone. However, it is considered that since the compound (III) has two or more A's, the crosslinking structure of a cured layer is three-dimensional and the cured layer eventually has higher mechanical strength. The compound (III) also serves to provide a crosslinking cured layer with moderate flexibility similarly to the D part in the compound containing F, D and A.

As the compound (III), those shown in the following structure group 5 are more preferable.

Structure group 5

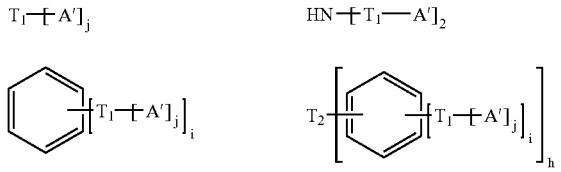

-continued

Structure group 5

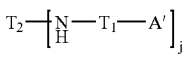

In the above formula, $T_1$ and $T_2$ each independently represent a divalent or trivalent hydrocarbon group which may be branched, A' represents the substituent as described above and h, i and j each independently denote an integer from 1 to 3 and the number of each is selected such that the number of A' in the molecule is 2 or more.

Specific examples of the compound (III) represented by these formulae are shown below, though the compound (III) is not limited to these examples.

III-1

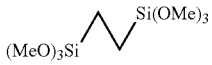

III-2

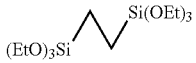

III-3

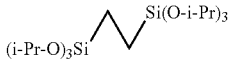

III-4

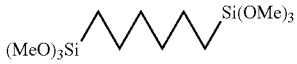

III-5

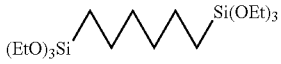

III-6

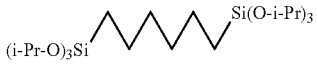

III-7

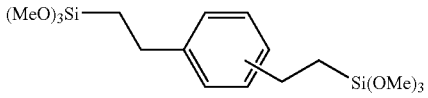

III-8

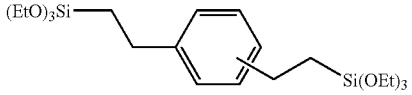

III-9

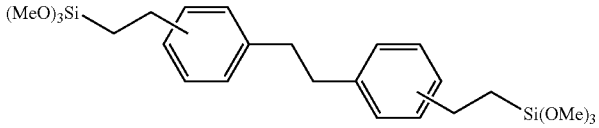

III-10

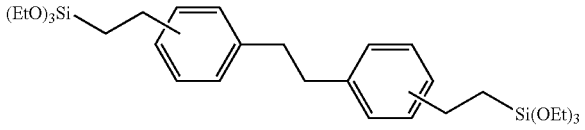

-continued

III-11 $(MeO)_3Si$—(CH$_2$)$_3$—NH—(CH$_2$)$_3$—$Si(OMe)_3$

III-12 $(MeO)_3Si$—(CH$_2$)$_3$—NH—(CH$_2$)$_3$—NH—(CH$_2$)$_3$—$Si(OMe)_3$

III-13 $(MeO)_2MeSi$—(CH$_2$)$_5$—$SiMe(OMe)_2$

III-14 $(MeO)_2MeSi$—(CH$_2$)$_2$—C$_6$H$_4$—(CH$_2$)$_2$—$SiMe(OMe)_2$

III-15 $(MeO)_3SiC_3H_6$—O—$CH_2CH\{$—O—$C_3H_6Si(OMe)_3\}$—$CH_2\{$—O—$C_3H_6Si(OMe)_3\}$

The photo-functional organic silicon compounds containing F, D and A may be used either singly or in combinations of two or more. The photo-functional organic silicon compound may be used by mixing it with other coupling agents, fluorine compounds and the like with the intention of controlling the filming ability and flexibility of the layer. As such a compound, various silane coupling agents and commercially available silicon type hard coating agents may be used.

Also, in the case where a crosslinking layer is formed as the surface protective layer, it is preferable to add an organic metal compound or a curable type matrix.

A coating solution of these compounds may be prepared using no solvent or using a solvent according to the need. As the solvent, alcohols such as methanol, ethanol, propanol and butanol; ketones such as acetone and methyl ethyl ketone; or ethers such as tetrahydrofuran, diethyl ether and dioxane may be used. Preferable solvents are those having a boiling point of 100° C. or less. These solvents may be mixed arbitrarily upon use. The amount of the solvent may be designed optionally. If the amount is too small, the aforementioned compound containing F, D and A tends to precipitate. The solvent is therefore used in an amount of 0.5 to 30 parts by mass and preferably 1 to 20 parts by mass based on one part of the compound containing F, D and A.

In the preparation of the coating solution, the compound containing F, D and A and as required, other compounds are brought into contact with a solid catalyst to react. The reaction temperature and time differ depending on the type of raw material. The reaction is run at a temperature of usually 0 to 100° C., more preferably 0 to 70° C. and particularly preferably 10 to 35° C. Although the reaction time is not particularly limited, it is preferable to continue the reaction for 10 minutes to 100 hours, because the coating solution is gelled easily if the reaction time is prolonged.

When the polymer having a group which can be bound with the compound containing F, D and A is added, gelation is outstandingly promoted if the solid catalyst and the polymer are present at the same time and coating may be difficult. Therefore, the polymer is preferably added after the solid catalyst is removed. The solid catalyst is not particularly limited as far as the catalyst component is insoluble in all of the solution of the compound containing F, D and A, the other compounds, the solvent and the like.

Although there is no particular limitation to the amount of water to be added in the hydrolysis-condensation, water is preferably used in a proportion of 30 to 500% and particularly 50 to 300% based on the theoretical amount necessary to hydrolyze all the hydrolyzable group of the compound containing F, D and A because it affects the preserving stability of the product and the restriction on gelation when subjected to the polymerization. When the amount of water exceeds 500%, the preserving stability of the product is impaired and precipitation tends to take place. When the amount of water is less than 30%, an unreacted product is increased, leading to phase separation when the coating solution is applied or cured and to reduced strength of the coating layer.

Then, a protonic acid such as hydrochloric acid, acetic acid, phosphoric acid or sulfuric acid is added as a curing catalyst to the coating solution to cure the solution. Although the curing temperature is arbitrarily set, it is set to 60° C. or more and preferably 80° C. or more to obtain desired strength. Although the curing time may be arbitrarily set according to the need, it is preferably 10 minutes to 5 hours. It is effective to stabilize the characteristics of the cured layer by keeping the layer in a highly humidified condition after the curing reaction is completed. Moreover, surface treatment may be carried out using hexamethyldisilazane or trimethylchlorosilane according to use to make the surface of the layer hydrophobic.

As a coating method, a usual method such as a blade coating method, wire bar coating method, spray coating method, dip coating method, beads coating method, air knife coating method or curtain coating method may be used.

In the photoreceptor used in the invention, an undercoat layer may be formed between the base material (conductive support) and the light-sensitive layer as desired. As a material to be used for forming the undercoat layer, a known binder resin which is currently used for undercoat layers may be used and the undercoat layer may also be formed of materials constituting the aforementioned surface layer. In this case, other materials such as a zirconium type compound and an electron-transferable pigment may be added.

In the case of disposing the surface protective layer in the photoreceptor used in the invention, light-sensitive layers used in all conventionally known photoreceptors may be adopted as the light-sensitive layer to be formed under the surface protective layer. Although the photoreceptor may be either a laminate type photoreceptor obtained by laminating a charge generating layer and an electron-transfer layer or a monolayer type photoreceptor containing a charge generating material, the laminate type photoreceptor is preferable in view of sensitivity, durability and the like.

The charge generating layer in the laminate type light-sensitive layer is formed of at least a charge generating material and a binder resin.

As the charge generating material, all known charge generating materials such as azo pigments such as bisazo and trisazo, condensed cyclic aromatic pigments such as dibromoanthoanthrone, perylene pigments, pyrrolopyrrole pigments and phthalocyanine pigments may be used. Particularly, metal or nonmetal phthalocyanine pigments are preferable. Among these phthalocyanines, hydroxygallium phthalocyanine, chlorogallium phthalocyanine, dichlorotin phthalocyanine and titanylphthalocyanine which have a specific crystal are particularly preferable. Also, the binder resin may be selected from wide-ranging insulation resins.

The ratio (mass ratio) of the charge generating material to the binder resin is preferably in a range of 10:1 to 1:10.

As a method of dispersing these materials, a usual method such as a ball mill dispersion method, attritor dispersion method or sand mill dispersion method may be used. In this case, it is necessary that the crystal type of the charge generating material is not changed.

In the above dispersion, organic solvents such as methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene may be used either singly or by mixing two or more.

The thickness of the charge generating layer is generally 0.1 to 5 μm and preferably 0.2 to 2.0 μm. As a coating method used when forming the charge generating layer, a blade coating method, wire bar coating method, spray coating method, dip coating method, beads coating method, air knife coating method or curtain coating method may be used.

As the charge transport layer in the photoreceptor used in the invention, a layer formed by known technologies may be used. The charge transport layer is formed by compounding a charge transfer material and a binder resin or may be formed by compounding a high-molecular charge transfer material.

Examples of the charge transfer material include electron transfer compounds such as p-benzoquinone, chloranil, bromanil and quinone type compounds such as anthraquinone, tetracyanoquinodimethane type compounds, fluorenone compounds such as 2,4,7-trinitrofluorenone, xanthone type compounds, benzophenone type compounds, cyanovinyl type compounds and ethylene type compounds; and hole transferable compounds such as triarylamine type compounds, benzidine type compounds, arylalkane type compounds, aryl-substituted ethylenic compounds, stilbene type compounds, anthracene type compounds and hydrazone type compounds. These charge transfer materials may be used either singly or by mixing two or more. However, the charge transfer materials are not limited to these compounds.

As the charge transfer material, triphenylamine type compounds represented by the formula (IV) and benzidine type compounds represented by the formula (V) are particularly preferably used because these compounds have high charge (hole) transfer ability and high stability.

Formula (IV)

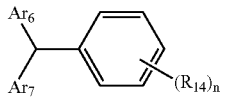

In the above formula (IV), $R_{14}$ represents a hydrogen atom or a methyl group, n denotes 1 or 2 and $Ar_6$ and $Ar_7$ each independently represent a substituted or unsubstituted aryl group, wherein as the substituent, a halogen atom, an alkyl group having 1 to 5 carbon atoms, an alkoxy group having 1 to 5 carbon atoms or a substituted amino group substituted with an alkyl group having 1 to 3 carbon atoms are exemplified.

Formula (V)

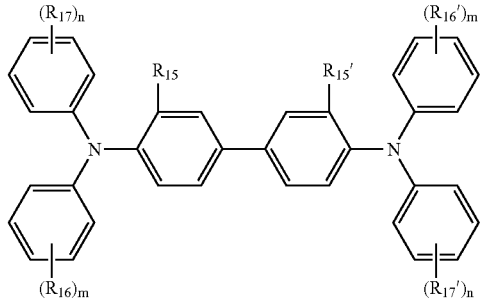

In the above formula (V), $R_{15}$ and $R_{15}'$ each independently represent a hydrogen atom, a halogen atom, an alkyl group having 1 to 5 carbon atoms or an alkoxy group having 1 to 5 carbon atoms, $R_{16}$, $R_{16}'$, $R_{17}$ and $R_{17}'$ each independently represent a hydrogen atom, a halogen atom, an alkyl group having 1 to 5 carbon atoms, an alkoxy group having 1 to 5 carbon atoms or an amino group substituted with an alkyl group having 1 to 2 carbon atoms and m and n each independently denote an integer from 0 to 2.

These charge transfer materials may be used either singly or by mixing two or more. Also, a high-molecular charge transfer material may be used.

Examples of the binder resin used in the charge transport layer include a polycarbonate resin, polyester resin, methacryl resin, acryl resin, polyvinyl chloride resin, polyvinylidene chloride resin, polystyrene resin, polyvinyl acetate resin, styrene-butadiene copolymer, vinylidene chloride/acrylonitrile copolymer, vinyl chloride/vinyl acetate copolymer, vinyl chloride/vinyl acetate/maleic acid copolymer, silicone resin, silicone-alkyd resin, phenol-formaldehyde resin and styrene-alkyd resin.

The above binder resins may be used either singly or by mixing two or more. The compounding ratio (mass ratio) of the charge transfer material to the binder resin is preferably in a range of 10:1 to 1:5. The thickness of the charge transfer material is preferably in a range of 5 to 50 μm and more preferably in a range of 10 to 30 μm. As a coating method, a usual method such as a blade coating method, wire bar coating method, spray coating method, dip coating method, beads coating method, air knife coating method or curtain coating method may be used.

As the solvent, aromatic hydrocarbons such as benzene, toluene, xylene and chlorobenzene; ketones such as acetone and 2-butanone; halogenated aliphatic hydrocarbons such as methylene chloride, chloroform and ethylene chloride; and cyclic or straight-chain ethers such as tetrahydrofuran and ethyl ether may be used either singly or mixing two or more.

As the conductive support, aluminum is usually used in an appropriate form such as a drum form, sheet form or plate form though the material used for the conductive support is not limited to these forms. In the case where a light-sensitive drum is used in a laser printer, the surface of the support is preferably surface-roughened such that the center-line average roughness $R_{a75}$ falls in a range of 0.04 μm to 0.5 μm to prevent an interference fringe generated when laser light is applied. As a surface roughing method, wet honing carried out by spraying a suspension solution, obtained by suspending an abrasive agent in water, on the support or centerless abrasion carried out by performing abrasion processing continuously while the support is pressed to a rotating grinding stone is preferable. When the $R_{a75}$ value is less than 0.04 μm, the surface of the support is close to a mirror surface, an interference preventive effect is not obtained. On the other hand, when the $R_{a75}$ value exceeds 0.5 μm, this is not proper because image quality becomes roughened even if a coating layer is formed as an undercoat layer. When non-interference light is used a light source, the surface roughing to prevent an interference fringe is not particularly necessary and the generation of defects due to irregularities on the surface of the base material is prevented. Therefore, the use of non-interference light is appropriate to achieve a long life.

In the case of providing no surface protective layer in the photoreceptor used in the invention, the outermost layer of the light-sensitive layer formed on the surface of the conductive support becomes the surface layer of the photoreceptor used in the invention. The light-sensitive layer include two types, namely a laminate type and a monolayer type.

In the case of the laminate type light-sensitive layer, the surface layer is the charge transport layer if the charge transport layer is disposed on the surface and the charge generating layer if the charge generating layer is disposed on the surface. In this case, the layer structure explained as the surface layer may be adopted as the outermost surface layer in place of the structure using the charge transport layer or charge generating layer as the outermost layer and as the other layers, the structure explained above is adopted as it is.

On the other hand, in the case of the monolayer type light-sensitive layer, it has a layer structure in which the light-sensitive layer itself constitutes the surface layer. In this case, it is necessary to add a charge generating material in the monolayer type light-sensitive layer. As the charge generating material, the same materials as in the case of the charge generating layer explained above may be used.

Next, each step in the image forming method of the invention will be explained.

The aforementioned charging step in the invention is a step of charging the surface of the latent image holding member evenly by using a charging means. Examples of the charging means include a non-contact type charger such as a corotron and scorotron and a contact type charger which charges the surface of the latent image holding member by applying voltage to a conductive member brought into contact with the surface of the latent image holding member and any type of charger may be used. However, it is preferable to use a contact charging type charger from the view point that this charger produces such an effect that the generation of ozone is decreased and this charger has no influence on the environment and is superior in durability. In the contact charging type charger, the conductive member may have any of a brush form, blade form, pin electrode form, roller form and the like: however, a roller-like member is preferable. The charging step in the image forming method of the invention is not particularly limited.

The step of forming an electrostatic latent image is a step of forming an electrostatic latent image by exposing the latent image holding member, whose surface is evenly charged, to light by an exposure means such as laser optical systems and LED arrays. The exposure system in the image forming method of the invention is not particularly limited.

The aforementioned developing step is a step of forming a toner image on the surface of the latent image holding member by bringing a developer support provided with a developer layer containing at least toner formed on its surface into contact with or making the developer support adjacent to the surface of the latent image holding member and by making a toner particle adhere to the electrostatic latent image on the surface of the latent image holding member. As to a developing method, the developing may be carried out using a known system. Examples of the developing system using a two-component developer which system is used in the invention include a cascade system and magnetic brush system. The developing system in the image forming method of the invention is not particularly limited.

The aforementioned transfer step is a step of forming a transfer image by transferring the toner image formed on the surface of the latent image holding member to a receiving member. In the case of forming a full-color image, it is preferable that each color toner be firstly transferred to an intermediate transfer drum or belt as an intermediate transfer member and then secondarily transferred to an image receiving member such as paper. Also, it is preferable that each color toner image be once transferred to an intermediate transfer member and then each color toner image simultaneously to an image receiving member from the viewpoint of generalization of paper and high quality image.

As a transfer device for transferring a toner image from the photoreceptor to paper or an intermediate transfer member, a corotron may be utilized. Although the corotron is effective as a means of charging a paper evenly, a voltage as high as several kV should be applied to give a predetermined charge to a paper which is an image receiving member and a high voltage power source is therefore required. Also, because ozone is generated by corona discharge, the deterioration of the rubber parts and photoreceptor are caused and it is therefore preferable to use a contact transfer system of transferring a toner image to a paper by pressing a conductive transfer roll made of elastic material to a latent image holding member.

The transfer device in the image forming method of the invention is not particularly limited.

The aforementioned fixing step is a step of fixing the toner image transferred to the surface of the image-receiving member by using a fixing device. As the fixing device, a heating fixing device using a heat roll is preferably used. The heating fixing device is constituted of a fixing roller provided with a heater lamp inside of a cylindrical core bar and a so-called release layer formed around the outside peripheral surface of the heater lamp by using a heat-resistant resin layer or a heat-resistant rubber coating layer and a pressure roller or belt which is arranged in forced contact with the fixing roller and has a structure in which a heat-resistant elastic layer is formed on the outside peripheral surface of a cylindrical core bar or on the surface of a belt-like base material. In a process of fixing the unfixed toner image, the image receiving member on which the unfixed toner image is formed is allowed to pass through a space between the fixing roller and the pressure roller or pressure belt (these parts are referred to as "fixing member") to heat-melt the binder resin and additives or the like in the toner, thereby carrying out fixing.

It is preferable that a fluorine resin be contained in the surface of the fixing roller and the fixing step be carried out by oilless fixing.

Specifically, the invention can provide an image forming method having, besides the aforementioned effects, an excellent release performance even in the oilless fixing which has been recently adopted as a fixing method in many image forming devices, that is, in a method of fixing without substantially supplying a releasing liquid such as silicone oil to the surface of a fixing member such as a fixing roller.

Because the toner used in the invention has a sufficient fixing latitude, the releasing liquid such as silicone oil and the like which is to be applied to the surface of the fixing member such as a fixing roller is substantially unnecessary. However, in, for example, the case of dealing with high-speed printing, only a little releasing liquid may be supplied to secure releasability without fail. The amount of the liquid required in this case is only 1 μl or less per A4 size (210 mm×297 mm) image-receiving member.

In the image forming method of the present invention, the fixing system is not particularly limited.

The aforementioned cleaning step is a step of removing remaining toner left as a transfer residue on the surface of the latent image holding member which has been processed in the transfer step. In this step, a blade, brush, roll or the like is brought into direct contact with the surface of the latent image holding member, thereby being able to remove toner, paper powder and dusts stuck to the surface of the latent image holding member.

A system which is mostly usually adopted is a blade cleaning system in which a blade made of rubber such as a polyurethane is brought into forced contact with a latent image holding member. Other systems may be adopted which include a magnetic brush system in which a magnet is fixedly disposed in the inside thereof, a cylindrical non-magnetic sleeve is disposed around the outside periphery of the magnet in a rotatable manner and a magnetic carrier is carried on the surface of the sleeve to recover toner and an electrostatic brush system in which a semiconductive resin fiber or an animal hair is made into a roll, which is made to be rotatable and a bias having polarity opposite to that of toner is applied to the roll to thereby remove toner.

In the invention, the blade cleaning system is preferably used because toner is recycled.

The image forming method of the invention further comprises a recycle step. The recycle step is a step of transferring the toner recovered in the cleaning step to, for example, a developing unit provided with a developer support.

The image forming method of the invention which is typified in the embodiment comprising this recycle step may be practiced using image forming devices such as toner recycle system type copying machines, printers and facsimiles or the like.

EXAMPLES

The present invention will be explained in detail by way of examples. However, the scope of the invention should not be construed to be limited thereto. In the explanations of a toner and a carrier, all designations of "parts" indicate "parts by weight", unless otherwise noted.

First, the toners, carriers and developers used in Examples and Comparative Examples will be explained.

<Methods for Measurement>

In the preparation of the following toners, carriers and developers, each measurement is performed according to the following methods.

(Measurement of the Volume Resistivity of a Carrier)

Figure 1:
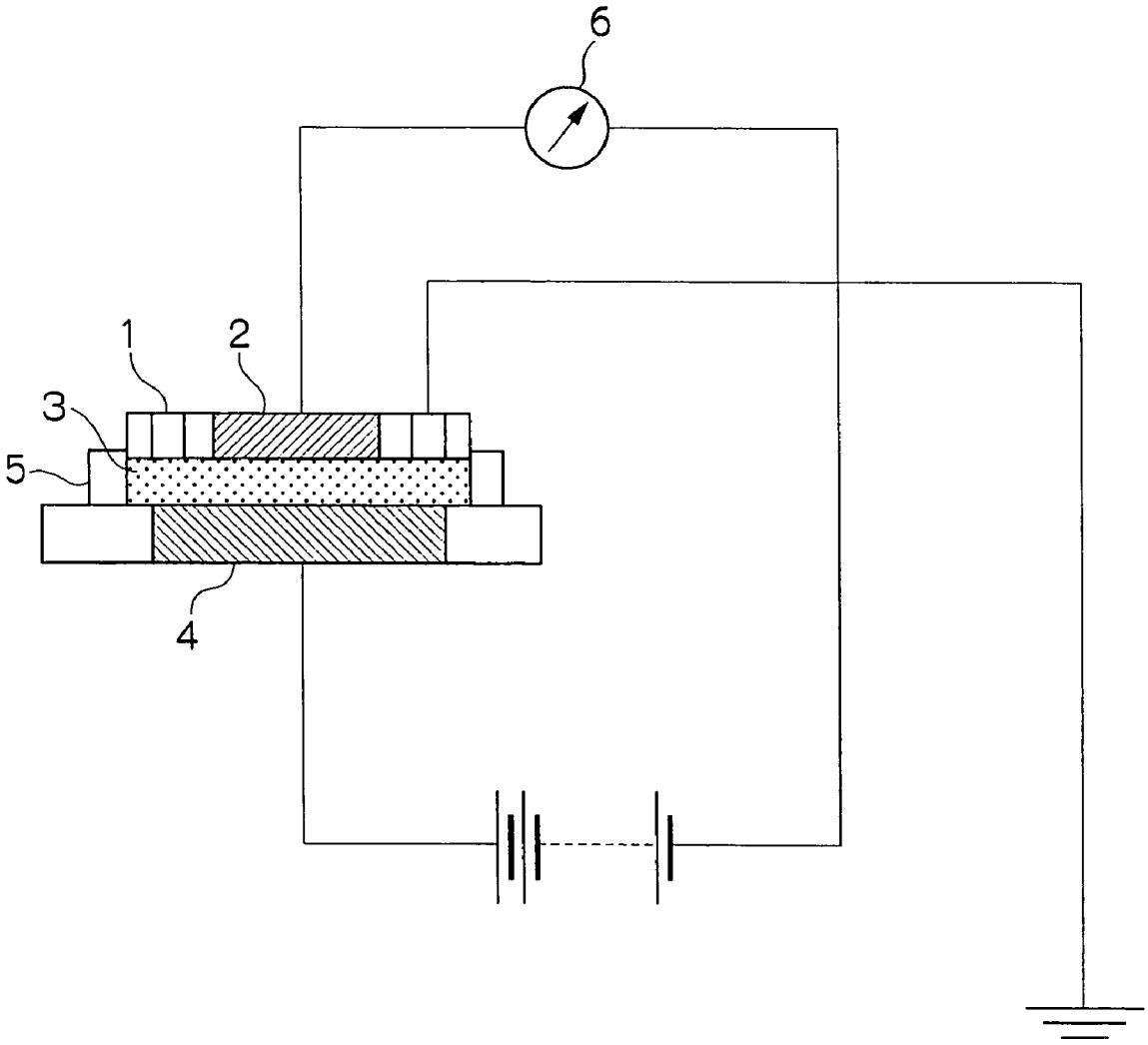
FIG. 1 is a schematic view for explaining a method of measuring volume resistivity.

As shown in FIG. 1, a sample 3 subjected to measurement is supported between a lower electrode 4 and an upper electrode 2. Then, the thickness L of the sample 3 is measured using a dial gauge and the electric resistance of the sample 3 is measured using a high voltage resister (electrometer) 6 with applying pressure from above the sample. In FIG. 1, 1 represents a guard electrode and 5 represents a sample support ring.

In the measurement of the volume resistivity of a carrier, the sample is filled in the lower electrode 4 having a diameter of 100 mm and the upper electrode 2 is set. A load of 3.43 g is applied from above the upper electrode 2 to measure the thickness L by using a dial gauge. Next, voltage is applied to find the volume resistivity by reading a current value.

The volume resistivity R (Ω·cm) is calculated according to the following equation.

$$R=\alpha\times E/(I-I_0)/L$$

In the above equation, E represents an applied voltage (V), I represents a current value (A), $I_0$ represents a current value (A) when the applied voltage is 0 V and L represents the thickness (mm) of the sample. The coefficient a represents the area ($cm^2$) of the electrode plate.

(Shape Factor SF1 of Toner)

In the invention, the shape factor SF1 of toner means an average of the values of individual toner particles which values are calculated according to the following equation as described above.

$$SF1=(ML^2/A)\times(\pi/4)\times 100$$

In the above equation, ML represents the maximum length of a toner particle and A represents the projected area of a toner particle. In the case of a true sphere, SF1 is 100.

As to a specific means for finding the aforementioned shape index, a toner image is read in an image analysis device (LUZEX III: manufactured by Nireco Corporation) from an optical microscope to measure a circular equivalent diameter. From the maximum length and area based on the circular equivalent diameter, SF1 in the above equation as to each particle is calculated to find the shape index.

(Measurement of the Amount of Toner Charge)

The amount of toner charge in an evaluation test using an actual machine, which will be explained later, is measured at 25° C. under 55% RH in the same manner as above described by using TB200 manufactured by Toshiba Corporation after about 0.4 g of a developer on a mug sleeve in a developing unit is collected. The measured toner density of each developer is about 5% by mass.

<Preparation of a Photoreceptor A>

A 84-mm-dia drawn pipe made of a JIS A3003 alloy is prepared and abraded using a centerless grinder to make a cylinder having a surface roughness (10 points average roughness Rz) of 0.6 μm. In a washing step, this cylinder is subjected to degreasing treatment, it is then subjected to etching treatment performed using a 2% by mass sodium hydroxide solution for one minute, followed by neutralizing treatment and further washing with pure water.

Next, in a step of anodic oxidation treatment, an anodic oxide film (current density: 1.0 A/dm$^2$) is formed on the surface of the cylinder by using a 10% by mass sulfuric acid solution. After washed with water, the cylinder is dipped in a 1% by mass nickel acetate solution kept at 80° C. for 20 minutes to carry out sealing treatment. The cylinder is further washed with water and dried. In this manner, an aluminum base material (conductive support) provided with the anodic oxide film formed on the surface of the aluminum cylinder and having a film thickness of 7 μm is obtained.

1 part of chlorogallium phthalocyanine having strong diffraction peaks at Bragg angles (2θ±0.2°) of 7.4°, 16.6°, 25.5° and 28.3° in the X-ray diffraction spectrum is mixed with 1 part of a polyvinylbutyral (Eslec BM-3: manufactured by Sekisui Chemical Co., Ltd.) and 100 parts of n-butyl acetate and the mixture is treated together with glass beads by using a paint shaker for 1 hour to produce a coating solution. The resulting coating solution is applied to the surface of the anodic oxide film of the aluminum base material by a dip coating method and dried under heating at 100° C. for 10 minutes to form a charge generating layer having a layer thickness of 0.15 μm.

2 Parts of a benzidine compound represented by the following formula (1) (wherein Me represents a methyl group) and 3 parts of a high-molecular compound (viscosity average molecular weight: 39,000) having the following formula (2) as a basic unit are dissolved in 20 parts of chlorobenzene to prepare a coating solution, which is then applied to the surface of the above charge generating layer by using a dip coating method and heated at 110° C. for 40 minutes to form a charge transport layer having a layer thickness of 20 μm.

Formula (1)

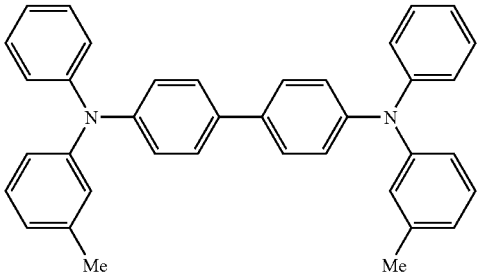

Formula (2)

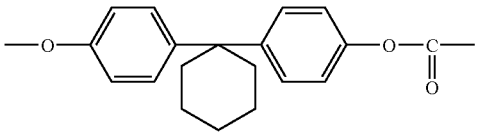

2 Parts of a compound (3) in which each substituent has a structure shown in Table 1 among compounds represented by the following formula (II), 2 parts of methyltrimethoxysilane, 0.5 parts of tetramethoxysilane and 0.3 parts of colloidal silica are dissolved in 5 parts of isopropyl alcohol, 3 parts of tetrahydrofuran and 0.3 parts of distilled water, to which is then added 0.5 parts of an ionic exchange resin (Anberlist 15E) and the mixture is stirred at ambient temperature to thereby carry out hydrolysis for 24 hours.

TABLE 1

Formula (II)

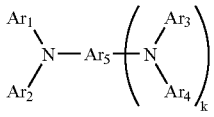

| Compound (3) | |
|---|---|
| k | 0 |
| $Ar_1$ | 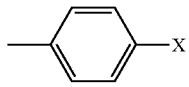 |
| $Ar_2$ | 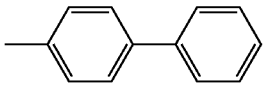 |
| $Ar_3$ | — |
| $Ar_4$ | — |
| $Ar_5$ | 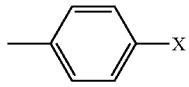 |
| X | $—(CH_2)_2—COO—(CH_2)_3—Si(OiPr)_3$ |

0.04 Parts of aluminum trisacetylacetonate and 0.1 parts of 3,5-di-t-butyl-4-hydroxytoluene (BHT) are added to 2 parts of a liquid prepared by separating the ionic exchange resin from the hydrolysate by filtration to prepare a surface protective layer coating solution. This coating solution is applied to the surface of the above charge transport layer by using a ring type dip coating method. The coating layer is air-dried for 30 minutes at ambient temperature and cured by heat treatment at 170° C. for 1 hour to form a surface protective layer having a layer thickness of about 3 μm, thereby forming a photoreceptor A.

<Preparation of Toner>

| (Preparation of a toner particle 1) | |
|---|---|
| Styrene/n-butylacrylate copolymer resin (Tg: 58° C., Mn: 4,000, Mw: 25,000) | 100 parts |
| Carbon black (Mogal L: manufactured by Cabot) | 3 parts |

A mixture of the above components is kneaded using an extruder and milled using a jet mill. Then, the mixture is dispersed using an air classifier to obtain a toner particle 1 (black) having a volume average particle diameter D50 of 7.8 μm and a shape factor SF1 of 148.8.

| (Preparation of a toner particle 2) | |
|---|---|
| Linear polyester (linear polyester obtained from terephthalic acid/bisphenol A.ethylene oxide adduct/cyclohexane dimethanol, Tg: 62° C., Mn: 4,000, Mw: 35,000, acid value: 12, hydroxyl value: 25) | 86 parts |
| Carbon black (R330: manufactured by Cabot) | 8 parts |
| Polyethylene wax (melting point: 135° C.) | 6 parts |

A mixture of the above components is kneaded using an extruder and milled using a surface milling system milling machine. Then, the mixture is classified into a fine particle and a coarse particle to obtain a particle having an intermediate size. This process is repeated three times to obtain a toner particle 2 (black) having a volume average particle diameter D50 of 8 μm and a shape factor SF1 of 128.5.

| (Preparation of a toner particle 3) | |
|---|---|
| Linear polyester (linear polyester obtained from terephthalic acid/bisphenol A.ethylene oxide adduct/cyclohexane dimethanol, Tg: 62° C., Mn: 4,000, Mw: 35,000, acid value: 12, hydroxyl value: 25) | 89 parts |
| Carbon black (R330: manufactured by Cabot) | 6 parts |
| Polyethylene wax (melting point: 135° C.) | 5 parts |

A mixture of the above components is kneaded using an extruder and milled using a surface milling system milling machine. Then, the mixture is classified into a fine particle and a coarse particle to obtain a particle having an intermediate size. This process is repeated three times to obtain a toner particle 3 (black) having a volume average particle diameter D50 of 10.5 μm and a shape factor SF1 of 135.6.

(Preparation of a Toner Particle 4)

Same procedures as in the preparation of the toner particle 2 are conducted except that treatment using heat air is carried out after the classification in the preparation of the toner particle 2, to obtain a nearly spherical toner particle 4 (black) having a volume average particle diameter D50 of 8.6 μm and a shape factor SF1 of 115.0.

| (Preparation of a toner particle 5) | |
|---|---|
| Linear polyester (linear polyester obtained from terephthalic acid/bisphenol A.ethylene oxide adduct/cyclohexane dimethanol, Tg: 62° C., Mn: 4,000, Mw: 35,000, acid value: 12, hydroxyl value: 25) | 90 parts |
| Cyan pigment (C.I. Pigment Blue 15:3) | 4 parts |
| Polyethylene wax (melting point: 135° C.) | 6 parts |

A mixture of the above components is kneaded using an extruder and milled using a surface milling system milling machine. Then, the mixture is classified into a fine particle and a coarse particle to obtain a particle having an intermediate size. This process is repeated three times to obtain a toner particle 5 (cyan) having a volume average particle diameter of 9.5 μm and a shape factor SF1 of 135.8.

| <Preparation of a carrier> | |
|---|---|
| Ferrite particle (volume average particle diameter: 50 μm) | 100 parts |
| Toluene | 14 parts |
| Styrene/methacrylate copolymer (component ratio: 90/10) | 2 parts |
| Carbon black (R330: manufactured by Cabot) | 0.2 parts |

First, the above components excluding a ferrite particle are stirred by a stirrer for 10 minutes to prepare a dispersed coating resin solution. Next, this coating resin solution and the above ferrite particle are placed in a vacuum deaeration type kneader, stirred at 60° C. for 30 minutes and deaerated under heating and reduced pressure, followed by drying to obtain a carrier.

This carrier has a volume resistivity of $10^{11}\Omega\cdot$cm in an electric field to which a voltage of 1000 V/cm is applied.

<Preparation of a Developer>

0.8 Parts of hydrophobic titania having an average particle diameter of 15 nm and treated with decylsilane and 1.3 parts of hydrophobic silica (NY50, manufactured by Nippon Aerosil Co., Ltd.) having an average particle diameter of 30 nm are added to 100 parts of each of the above toner particles 1 to 5. These components containing each particle are blended at a peripheral speed of 32 m/sec for 10 minutes by using a Henschel mixer and then a coarse particle is removed using a 45 μm mesh sieve to obtain toners 1 to 5.

100 Parts of the above carrier and 6 parts of the above each toner are stirred at 40 rpm for 20 minutes by using a V-blender and screened using a 177 μm mesh sieve to obtain 5 developers.

EXAMPLE 1

Each of the aforementioned toners and each of the developers using the toners are respectively filled in the toner cartridge and developing unit of a DocuCentre Color 500 manufactured by Fuji Xerox Co., Ltd. which is adapted such that recycled toner is returned to a toner supply section, and a long-term duration test is performed to evaluate fogging, image running and the like.

The modified DocuCentre Color 500 is an image forming device comprising a latent image holding member, a charging means for charging the surface of the latent image holding member, an electrostatic latent image forming means for forming an electrostatic latent image on the charged latent image holding member, a developing unit in which a developer comprising a toner and a carrier is stored and which develops the electrostatic latent image by a layer of the developer which layer is formed on the surface of a developer support to form a toner image on the surface of the latent image holding member, a transfer means for transferring the toner image to an intermediate transfer member and a cleaning means using a cleaning blade system.

In this case, a toner band is formed on the surface of the latent image holding member every fixed number of copies and is controlled such that it is not transferred but wholly recovered in a cleaning device. The frequency of formation of the toner band is changed to control such that the ratio of the recycled toner to the total amount of the supply toner supplied from the toner cartridge is 15% by weight or greater when 5000 copies of A4 size image are printed from the start.

The ratio of the recycled toner to the total amount of the supply toner is found by measuring the amount the recycled toner which is recovered to the toner supply section every fixed number of printed sheets and finally supplied to the developer and the amount of the supply toner supplied to the developer from the toner cartridge respectively in the condition of the evaluation device which has been operated for one minute.

After 5000 copies are printed, printing is continued up to 20,000 copies with maintaining the above condition. When 20,000 copies are printed, the amount of toner charge and image qualities (fogging on background and image running) are evaluated. The fogging on the background and image running are evaluated according to the following standards.

—Fogging on Background—

Sensorial evaluation of fogging on a non-image part in the print image is conducted by judging visually as follows.

○ . . . Not polluted at all.

Δ . . . Slightly polluted but allowable level.

× . . . Polluted to the extent that the border between the non-developed zone (margin part) and the non-image part is clearly perceived.

—Image Running—

Sensorial evaluation of image running in the print image is conducted by judging visually as follows.

○ . . . Image running is not observed at all.

× . . . Image running is observed.

The results are shown in Table 2.

EXAMPLE 2

Evaluation is made in the same manner as in Example 1 except that the ratio of the recycled toner to the supply toner after 5,000 copies are printed is adjusted to 20% by weight. The results are shown in Table 2.

EXAMPLE 3

Evaluation is made in the same manner as in Example 1 except that the ratio of the recycled toner to the supply toner after 5,000 copies are printed is adjusted to 25% by weight. The results are shown in Table 2.

COMPARATIVE EXAMPLE 1

Evaluation is made in the same manner as in Example 1 except that the ratio of the recycled toner to the supply toner after 5,000 copies are printed is adjusted to 10% by weight. The results are shown in Table 2.

TABLE 2

| | Comparative Example 1 | | | Example 1 | | | Example 2 | | | Example 3 | | |
|---|---|---|---|---|---|---|---|---|---|---|---|---|
| | The ratio of the recycled toner (% by weight) | | | | | | | | | | | |
| | 10 | | | 15 | | | 20 | | | 25 | | |
| Toner No. | Charge (μC/g) | Fogging on the background | Image running | Charge (μC/g) | Fogging on the background | Image running | Charge (μC/g) | Fogging on the background | Image running | Charge (μC/g) | Fogging on the background | Image running |
| 1 | −21 | X | X | −20 | Δ | ○ | −23 | ○ | ○ | −24 | ○ | ○ |
| 2 | −18 | X | X | −20 | ○ | ○ | −21 | ○ | ○ | −23 | ○ | ○ |
| 3 | −20 | X | X | −23 | ○ | ○ | −24 | ○ | ○ | −25 | ○ | ○ |
| 4 | −20 | X | X | −23 | ○ | ○ | −22 | ○ | ○ | −23 | ○ | ○ |
| 5 | −22 | X | X | −23 | ○ | ○ | −25 | ○ | ○ | −24 | ○ | ○ |

As shown in Table 2, when the ratio of the recycled toner to the total amount of the supply toner is set to 15% by weight or greater according to the image forming method of the invention, neither fogging on the background nor running unevenness of a print image is found, showing that good results are obtained. On the other hand, when the ratio of the recycled toner to the total amount of the supply toner is 10% by weight, fogging on the background and running unevenness of a print image are observed, showing unsatisfactory image quality.

EXAMPLE 4

The long-term duration tests are made in the same manner as in Examples 1 to 3 and Comparative Example 1 respectively except that as the photoreceptor, the photoreceptor A in which the surface layer is made of a crosslinked resin having a siloxane bond is used in place of the DocuCentre Color 500 original photoreceptor (organic photoreceptor).

As a result, the amount of toner charge and image quality after printing 20,000 copies in each Example are almost the same as the results of each of Examples 1 to 3 and Comparative Example 1 respectively. When the ratio of the recycled toner to the supply toner is 10% by weight, fogging on the background and running unevenness of a print image are observed, showing unsatisfactory image quality, whereas when the ratio of the recycled toner is 15% by weight or greater, there is no problem.

The next test use the original photoreceptor which has printed 20,000 copies in Example 1 and the photoreceptor A which has printed 20,000 copies in the condition that the ratio of the recycled toner is set to 15% by weight in the present example (Example 4). These two photoreceptors are used to continuously print until 40,000 copies respectively under the condition that the ratio of the recycled toner to the supply toner is set to 15% by weight. Then, pollution and damages on the surface of the photoreceptor are visually evaluated.

As a result, after 20,000 copies are printed, neither pollution nor damages are observed on either photoreceptor. However, after 40,000 copies are printed, pollution and damages appear on the surface of the original photoreceptor. In the case of the photoreceptor A, on the contrary, neither pollution nor damages are hardly observed on the surface of the photoreceptor even after 40,000 copies are printed, causing no practical problem.

According to the invention, it is possible to provide an image forming method which continuously provides a high quality image free from image defects in a stable manner in an image forming method in which remaining toner recovered from the surface of a latent image holding member in a cleaning step after a transfer step is returned to a developing section or a toner supply section through a toner recovery device and reused as recycled toner.

Also, according to the invention, it is possible to provide an image forming method in which cleaning characteristics in a cleaning step is stabilized and the characteristics of a latent image holding member can be maintained for a long period of time.

What is claimed is:

1. An image forming method comprising:

a charging step of charging a surface of a latent image holding member;

a latent image forming step of forming an electrostatic latent image on the surface of the latent image holding member;

a developing step of forming a toner image on the surface of the latent image holding member by using a developer;

a transfer step of transferring the toner image formed on the surface of the latent image holding member to a surface of a receiving member;

a toner band forming step of forming a toner band on the surface of the latent image holding member to attain a recycled toner ratio; and a cleaning step of recovering remaining toner on the surface of the latent image holding member as recycled toner, wherein the recycled toner is supplied to the developer as a part of supply toner, and the ratio of the recycled toner to a total amount of the supply toner supplied to the developer is 15% by weight or greater.

2. The image forming method of claim 1, wherein the toner band is formed once per from 10 to 200 printed sheets of an A4 size image.

3. The image forming method of claim 1, wherein the toner band has a length of from 0.5 mm to 20 mm in a direction of rotation of the latent image holding member and has an image density of from 30% to 100%.

4. The image forming method of claim 1, wherein blade cleaning is carried out in the cleaning step.

5. The image forming method of claim 1, further comprising a fixing step of fixing the toner image transferred to the surface of the receiving member with heat, wherein a releasing liquid is not supplied to a surface of a fixing member in the fixing step.

6. The image forming method of claim 1, wherein the recycled toner is added to the supply toner in a ratio of 20% by weight or greater to the total amount of the supply toner.

7. The image forming method of claim 1, wherein the toner has a shape factor SF1 of from 100 to 140, the SF1 being calculated according to the following equation:

$$SF1=(ML^2/A)\times(\pi/4)\times 100$$

wherein ML represents a maximum length of a toner particle, and A represents a projected area of the toner particle.

8. The image forming method of claim 7, wherein the toner has the SF1 of from 110 to 135.

9. The image forming method of claim 1, wherein the toner contains a releasing agent.

10. The image forming method of claim 1, wherein the developer is a two-component developer comprising a carrier and a toner, and the toner is a non-magnetic toner.

11. The image forming method of claim 10, wherein the carrier has a resin layer on a surface thereof.

12. The image forming method of claim 1, wherein the toner has at least one of an inorganic powder and a resin powder on a surface thereof.

13. The image forming method of claim 1, wherein the developer is a two-component developer comprising a carrier and a toner, and the carrier is a resin coated carrier which has a resin coating layer on a surface of a core material.

14. The image forming method of claim 13, wherein the resin coated carrier contains a conductive material dispersed in the resin layer.

15. The image forming method of claim 13, wherein the resin layer has an average thickness of from 0.1 to 10 μm.

16. The image forming method of claim 1, wherein the developer is a two-component developer comprising a carrier and a toner, and the carrier has a volume resistivity in a range of $10^6\Omega\cdot$cm to $10^{14}\Omega\cdot$cm provided that a developing contrast potential is from $10^3$V/cm to $10^4$V/cm.

17. The image forming method of claim 1, wherein the latent image holding member has a surface layer that contains a crosslinked resin having a siloxane bond.

18. The image forming method of claim 1, wherein the toner band forming step is carried out when a usual image formation is suspended.

19. The image forming method of claim 18, wherein the toner band forming step is carried out during the time when no recording paper is supplied between an image forming cycle and the next image forming cycle.

* * * * *